US008393942B2

(12) United States Patent
Blaha et al.

(10) Patent No.: US 8,393,942 B2
(45) **Date of Patent: *Mar. 12, 2013**

(54) METHODS FOR DISPLACING CHIPS IN A CHIP STACK

(75) Inventors: Ernst Blaha, Tullnerbach (AT); Peter Krenn, Neufeld (AT)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/098,269

(22) Filed: Apr. 29, 2011

(65) Prior Publication Data

US 2011/0207390 A1 Aug. 25, 2011

Related U.S. Application Data

(63) Continuation of application No. 11/583,520, filed on Oct. 19, 2006, now Pat. No. 7,934,980, which is a continuation-in-part of application No. 11/004,006, filed on Dec. 3, 2004, now Pat. No. 7,992,720, which is a continuation of application No. PCT/AT03/00149, filed on May 26, 2003.

(30) Foreign Application Priority Data

Jun. 5, 2002 (AT) ..... 359/2002

(51) Int. Cl.
*G07D 9/06* (2006.01)

(52) U.S. Cl. ..... 453/61; 453/26

(58) Field of Classification Search ..... 453/61, 453/12, 13, 29, 30, 31, 35, 49, 57, 26, 62; 206/0.8, 0.81; 232/1 D, 7, 9; 414/815, 816; 221/164, 175, 178, 206, 207, 289; 53/532
See application file for complete search history.

(56) References Cited

U.S. PATENT DOCUMENTS

| | | | | |
|---|---|---|---|---|
| 1,200,843 | A | | 10/1916 | Johnson et al. |
| 1,241,632 | A | * | 10/1917 | Johnson ..... 53/254 |
| 1,813,296 | A | | 7/1931 | Kidwell |
| 1,947,456 | A | | 2/1934 | Bock |
| 2,020,293 | A | | 11/1935 | Adelstein |
| 2,231,093 | A | | 2/1941 | Seemel |
| 2,904,151 | A | | 9/1959 | Johnson |

(Continued)

FOREIGN PATENT DOCUMENTS

| | | |
|---|---|---|
| AT | 006 405 | 10/2003 |
| AT | 006 546 | 12/2003 |

(Continued)

OTHER PUBLICATIONS

PCT International Search Report and Written Opinion of the International Searching Authority for PCT/GB2010/051763, dated Mar. 30, 2011, 14 pages.

(Continued)

*Primary Examiner* — Mark Beauchaine
(74) *Attorney, Agent, or Firm* — TraskBritt

(57) ABSTRACT

Apparatuses for stacking chips include a container for receiving unstacked chips, a carrier comprising a channel for carrying a chip stack, a transport system for transporting chips from the container toward the carrier, and at least one ejector system for ejecting or moving chips from the transport system into the channel of the carrier. Chip stack cutter devices may include an elongated displacement member, which may extend from an actuating lever member movably coupled to a base member configured to slide along a channel of a chip stack carrier. In additional embodiments, the cutter device may include an energy-responsive device configured to selectively move an elongated displacement member for displacing a number of chips in a chip stack carried in a channel of a chip stack carrier.

20 Claims, 6 Drawing Sheets

U.S. PATENT DOCUMENTS

| | | | | |
|---|---|---|---|---|
| 3,143,118 | A | | 8/1964 | Haines |
| 3,371,761 | A | | 3/1968 | Ryo |
| 3,387,616 | A | | 6/1968 | Bortz et al. |
| 3,435,833 | A | | 4/1969 | Tanaka |
| 3,497,047 | A | | 2/1970 | Mobley |
| 3,583,410 | A | | 6/1971 | Bayha et al. |
| 3,680,566 | A | | 8/1972 | Tanaka et al. |
| 3,766,452 | A | | 10/1973 | Burpee et al. |
| 3,771,538 | A | | 11/1973 | Reis |
| 3,827,582 | A | | 8/1974 | Lederer |
| 4,157,139 | A | * | 6/1979 | Bjork ..... 209/552 |
| 4,161,381 | A | | 7/1979 | Sciortino |
| 4,209,960 | A | | 7/1980 | Deutschlander et al. |
| 4,275,751 | A | | 6/1981 | Bergman |
| 4,360,034 | A | | 11/1982 | Davila et al. |
| 4,531,531 | A | | 7/1985 | Johnson et al. |
| 4,543,969 | A | | 10/1985 | Rasmussen |
| 4,607,649 | A | | 8/1986 | Taipale et al. |
| 4,681,128 | A | | 7/1987 | Ristvedt et al. |
| 4,731,043 | A | | 3/1988 | Ristvedt et al. |
| 4,775,354 | A | | 10/1988 | Rasmussen et al. |
| 4,863,414 | A | | 9/1989 | Ristvedt et al. |
| 4,966,570 | A | | 10/1990 | Ristvedt et al. |
| 5,011,455 | A | | 4/1991 | Rasmussen |
| 5,011,456 | A | | 4/1991 | Kobayashi et al. |
| 5,022,889 | A | | 6/1991 | Ristvedt et al. |
| 5,042,810 | A | | 8/1991 | Williams |
| 5,074,434 | A | | 12/1991 | Maki |
| 5,141,443 | A | | 8/1992 | Rasmussen et al. |
| 5,166,502 | A | | 11/1992 | Rendleman et al. |
| 5,207,612 | A | | 5/1993 | Wollaston |
| 5,277,651 | A | | 1/1994 | Rasmussen et al. |
| 5,406,264 | A | | 4/1995 | Plonsky et al. |
| 5,460,295 | A | | 10/1995 | Law |
| 5,472,074 | A | | 12/1995 | Milcetic |
| 5,531,331 | A | | 7/1996 | Barnett |
| 5,551,542 | A | | 9/1996 | Stockli |
| 5,607,352 | A | | 3/1997 | Tani |
| 5,624,308 | A | | 4/1997 | Rumbach |
| 5,651,548 | A | | 7/1997 | French et al. |
| 5,735,742 | A | | 4/1998 | French |
| 5,755,618 | A | | 5/1998 | Mothwurf |
| 5,757,876 | A | | 5/1998 | Dam et al. |
| 5,770,533 | A | | 6/1998 | Franchi |
| 5,781,647 | A | | 7/1998 | Fishbine et al. |
| 5,827,117 | A | | 10/1998 | Naas |
| 5,836,583 | A | | 11/1998 | Towers |
| 5,865,673 | A | | 2/1999 | Geib et al. |
| 5,895,321 | A | | 4/1999 | Gassies et al. |
| 5,931,732 | A | | 8/1999 | Abe et al. |
| 5,933,244 | A | | 8/1999 | Kiritchenko |
| 5,947,257 | A | | 9/1999 | Schwartz |
| 5,950,796 | A | | 9/1999 | Kobayashi |
| 5,957,262 | A | | 9/1999 | Molbak et al. |
| 5,957,776 | A | | 9/1999 | Hochne |
| 6,021,949 | A | | 2/2000 | Boiron |
| 6,075,217 | A | | 6/2000 | Kiritchenko |
| 6,080,056 | A | | 6/2000 | Karlsson |
| 6,139,418 | A | | 10/2000 | Geib et al. |
| 6,168,001 | B1 | | 1/2001 | Davis |
| 6,186,895 | B1 | | 2/2001 | Oliver |
| 6,193,599 | B1 | | 2/2001 | Kurosawa et al. |
| 6,260,757 | B1 | | 7/2001 | Strisower |
| 6,264,109 | B1 | | 7/2001 | Chapet et al. |
| 6,283,856 | B1 | | 9/2001 | Mothwurf |
| 6,296,190 | B1 | | 10/2001 | Rendleman |
| 6,313,871 | B1 | | 11/2001 | Schubert |
| 6,381,294 | B1 | | 4/2002 | Britton |
| 6,464,584 | B2 | | 10/2002 | Oliver |
| 6,506,115 | B1 | | 1/2003 | Mothwurf |
| 6,532,297 | B1 | | 3/2003 | Lindquist |
| 6,540,602 | B2 | | 4/2003 | Adams et al. |
| 6,567,159 | B1 | | 5/2003 | Corech |
| 6,572,474 | B2 | | 6/2003 | Rudd |
| 6,581,747 | B1 | | 6/2003 | Charlier et al. |
| 6,592,445 | B2 | | 7/2003 | Lee |
| 6,629,591 | B1 | | 10/2003 | Griswold et al. |
| 6,733,388 | B2 | | 5/2004 | Mothwurf |
| 6,753,830 | B2 | | 6/2004 | Gelbman |
| 6,772,870 | B2 | | 8/2004 | Sugai et al. |
| 6,976,589 | B2 | | 12/2005 | De Raedt et al. |
| 7,004,831 | B2 | | 2/2006 | Hino et al. |
| 7,014,554 | B1 | | 3/2006 | Fletcher et al. |
| 7,028,826 | B2 | | 4/2006 | De Raedt et al. |
| 7,066,335 | B2 | | 6/2006 | Aas et al. |
| 7,201,268 | B2 | | 4/2007 | DeMeutter et al. |
| 7,681,708 | B2 | | 3/2010 | De Raedt et al. |
| 7,934,980 | B2 | * | 5/2011 | Blaha et al. ..... 453/61 |
| 2004/0149539 | A1 | | 8/2004 | De Raedt et al. |
| 2005/0155838 | A1 | | 7/2005 | Raedt et al. |
| 2005/0280212 | A1 | | 12/2005 | Blaha et al. |
| 2007/0099553 | A1 | | 5/2007 | Blaha et al. |
| 2007/0212996 | A1 | | 9/2007 | Ryou |
| 2011/0105002 | A1 | | 5/2011 | Blaha et al. |

FOREIGN PATENT DOCUMENTS

| | | |
|---|---|---|
| AT | 007 854 | 10/2005 |
| CA | 2090073 | 8/1994 |
| CA | 2229054 | 8/1996 |
| CA | 2229053 | 10/1996 |
| DE | 3144327 | 5/1983 |
| DE | 4240886 | 7/1994 |
| EP | 0424355 | 11/1994 |
| EP | 0631260 | 12/1994 |
| EP | 0757582 | 2/1997 |
| EP | 0806020 | 12/1998 |
| EP | 1080348 | 8/2002 |
| EP | 0823041 | 9/2002 |
| EP | 0950989 | 9/2003 |
| EP | 1050024 | 3/2004 |
| FR | 2 749 093 | 7/1998 |
| FR | 2 752 078 | 10/1998 |
| GB | 720 707 | 12/1954 |
| GB | 1 255 492 | 12/1971 |
| GB | 1 571 219 | 7/1980 |
| GB | 2 061 490 | 5/1981 |
| GB | 2 203 582 | 10/1988 |
| GB | 2 254 419 | 10/1992 |
| GB | 2 198 274 | 6/1998 |
| GB | 2 333 632 | 7/1999 |
| IT | 94 A001040 | 12/1994 |
| WO | WO 91/17842 | 11/1991 |
| WO | WO 92/11953 | 7/1992 |
| WO | WO 95/28996 | 11/1995 |
| WO | WO 96/23281 | 8/1996 |
| WO | WO 96/34258 | 10/1996 |
| WO | WO 99/38126 | 7/1999 |
| WO | WO 99/60353 | 11/1999 |
| WO | WO 03/049045 | 6/2003 |
| WO | WO 03/103860 | 12/2003 |
| WO | WO2004/009256 | 1/2004 |
| WO | WO 2004/069431 | 8/2004 |
| WO | WO 2008/046561 | 4/2008 |
| WO | WO 2011/051700 | 5/2011 |

OTHER PUBLICATIONS

Separate submission containing the following documents: 1. Cover sheet of 1993 video tape 2. List of the first Chipmaster installations (Date of delivery) 3. Training handouts from Jan. 1994 4. Huxley's advertisement for Chipmaster ("Casino World" is distributed in the U.S.)—Mar. 1994 5. Show report Monte Carlo by Christian Pohanka (the inventor)—Mar. 23, 1993 6. Trial installation at Holland Casinos, report by Christian Pohanka—Sep. 29, 1993 7. Report from Spain by Christina Pohanka—Sep. 26, 1993 8. Photograph of first installation at Casino Baden (Austria)—Jan. 4, 2004 9. Photograph of first installation at Holland Casinos—Jan. 4, 2004 10. Photograph of first installation at Valencia (Spain)—Jan. 4, 2004 11. Photograph of Chipmaster production at VICOMA, Vienna—Jan. 4, 2005 12. Photographs of Chipmaster in Paulson Booth at Apr. 26-27, 1994 Show 13. Easy, Chipper Brochure 14. Easy Chipper Color Computer Model Schematics 15. Chipmaster brochure.

International Preliminary Report dated Apr. 22, 2009 for PCT Application PCT/EP2007/008873 (6 pages) (Easy Chipper with comfort cutter).
International Written Opinion dated Jun. 23, 2006 for PCT Application PCT/US2004/02331 (3 pages).
International Preliminary Report dated Dec. 14, 2006 for PCT Application PCT/US2004/02331 (3 pages).
International Written Opinion dated Mar. 6, 2008 for PCT Application PCT/EP2007/008873 (5 pages) (Easy Chipper with comfort cutter).
PCT International Search Report and Written Opinion of the International Searching Authority for PCT/GB2010/051763 dated Mar. 30, 2011, 14 Pages.

* cited by examiner

METHODS FOR DISPLACING CHIPS IN A CHIP STACK

CROSS-REFERENCE TO RELATED APPLICATIONS

This application is a continuation of application Ser. No. 11/583,520 filed Oct. 19, 2006, now U.S. Pat. No. 7,934,980, issued May 3, 2011, which in turn, is a continuation-in-part of application Ser. No. 11/004,006, filed Dec. 03, 2004, now U.S. Pat. No. 7,992,720 issued Aug. 9, 2011 , the disclosure of which is incorporated herein in its entirety by this reference, which is a continuation of International Patent Application No. PCT/AT03/00149, filed May 26, 2003, which in turn claims priority to Austrian Provisional Application No. 359/2002, filed Jun. 5, 2002.

BACKGROUND OF THE INVENTION

1. Field of the Invention

The present invention generally relates to apparatuses and methods that can be used to stack chips. Such apparatuses and methods may be used, for example, to sort gaming chips by color, size, or any other distinguishing feature, to count the sorted gaming chips, and to stack the sorted and counted chips for reuse in a game.

2. State of the Art

Various sorting and stacking devices for gaming chips have been presented in the art. For example, United Kingdom Patent Publication No. GB2061490A, published May 13, 1981, discloses a chip sorting and stacking device that sorts chips according to their color. A hopper is used to feed chips into holes provided on a conveyor belt. The conveyer belt causes the chips to pass several stations, each of which is configured to receive chips of a particular color. As each chip passes each station, a photoelectric detector is used to ascertain whether the color of the chip corresponds to the particular color designated for that particular station. If it does, a mechanism is used to press the chip through an opening into a storage compartment. An additional conveyor belt is used to deliver a desired number of chips from the storage compartment to a person operating the chip sorting and stacking device.

As another example, United Kingdom Patent Publication No. GB2254419A, published Jul. 10, 1992, describes another chip sorting and stacking device. A hopper is used to feed chips individually into formations or spaces positioned proximate the periphery of a disc that is inclined at an acute angle to the horizontal. As the disc is spun about its central axis, the chips are carried along an arcuate path to a location at which a deflector is used to move the chips from the disc to a conveyor. The conveyor carries the chips to an array of chip ejectors that are used to eject each chip carried by the conveyor into one of a plurality of chip stacking columns. A sensor is used to identify a particular characteristic of each chip, such as color, and a microprocessor is used to determine which chip ejector is to be actuated to cause each chip to be ejected into the appropriate chip stacking column corresponding to the particular chip characteristic exhibited by each respective chip.

As yet another example, U.S. Pat. No. 6,381,294 to Britton, issued Apr. 30, 2002, discloses a chip stacking device in which a hopper is used to feed chips to a conveyor, which carries the chips past a color sensor and a subsequent linear array of solenoids, which are used to transfer each chip into an appropriate stack. The conveying and sorting speed of the chip sorting and stacking device is controlled based on the number of chips in the hopper and conveyor, as determined using a detector.

In each of the chip stacking devices described above, the chips are sorted by an identifying characteristic and arranged in corresponding stacks, from which the chips may be removed by a croupier or other person using the chips in a game.

BRIEF SUMMARY OF THE INVENTION

In one embodiment, the present invention includes a chip stack cutter device that comprises an elongated displacement member that is configured to extend adjacent to, or under, a number of chips in a stack of chips carried by or in a channel of a chip stack carrier. The elongated displacement member may extend from an actuating lever member, which may be movably coupled to a base member. The base member may be configured to slide along the channel of a chip stack carrier. Movement of the actuating lever member relative to the base member may cause the elongated displacement member to displace at least one chip in a stack of chips relative to the channel of the chip stack carrier and/or other chips in the stack of chips.

In another embodiment, the present invention includes a chip stack cutter device that comprises a selectively powerable, energy-responsive device such as an electrical, electromechanical, pneumatic or hydraulic device for displacing a number of chips in a stack of chips carried by or in a channel of a chip stack carrier. The energy-responsive device may be configured to selectively move an elongated displacement member that is configured to extend adjacent to, or under, a number of chips in a stack of chips so as to displace those chips relative to the channel of the chip stack carrier and/or other chips in the stack of chips. The elongated displacement member may be moveably coupled to a base member that is configured to slide along a channel of a chip stack carrier.

In yet another embodiment, the present invention includes an apparatus for stacking chips. The apparatus includes a container for receiving unstacked chips, a chip stack carrier comprising at least one channel for carrying a stack of chips, a chip transport system for transporting unstacked chips from the container towards the chip stack carrier, and at least one chip ejector system for ejecting or moving chips from the chip transport system into the at least one channel of the chip stack carrier. The apparatus may further include at least one chip stack cutter device for displacing a number of chips in a stack of chips carried in a channel of a chip stack carrier. The chip stack cutter device may include an elongated displacement member that is configured to extend adjacent to, or under, a number of chips in a stack of chips carried by or in a channel of a chip stack carrier. The elongated displacement member may extend from an actuating lever member, which may be movably coupled to a base member. The base member may be configured to slide along the channel of a chip stack carrier. Movement of the actuating lever member relative to the base member may cause the elongated displacement member to displace a number of chips in a stack of chips relative to the channel of the chip stack carrier and/or other chips in the stack of chips. As an additional or alternative structure, the chip stack cutter device may include an energy-responsive device configured to selectively move an elongated displacement member that is configured to extend adjacent to, or under, a number of chips in a stack of chips so as to displace those chips relative to the channel of the chip stack carrier and/or other chips in the stack of chips. The elongated displacement member may be moveably coupled to a base member that is configured to slide along a channel of a chip stack carrier.

In an additional embodiment, the present invention includes an apparatus for stacking chips. The apparatus includes a container for receiving unstacked chips, a chip stack carrier comprising at least one channel for carrying a stack of chips, a chip transport system for transporting unstacked chips from the container toward the chip stack carrier, and at least one chip ejector system for ejecting or moving chips from the chip transport system into the at least one channel of the chip stack carrier. The chip transport system may include a disc oriented at an acute angle relative to the gravitational field, a plurality of chip slots on or in the disc, each chip slot having a size and shape configured to receive a single chip therein, and a device configured to rotate the disc. Each of the chip slots may pass through at least a portion of the container and towards the chip stack carrier upon rotation of the disc. The at least one chip ejector system may comprise an ejector arm, at least a portion of which is configured to selectively enter a chip slot of the plurality of chip slots on or in the disc from a side of the disc opposite the chip stack carrier to force any chip located within the chip slot entered by the at least a portion of the ejector arm out from the respective chip slot into the at least one channel of the chip stack carrier.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein should not be interpreted in a limiting sense as actual views of any particular apparatus or system, but are merely idealized representations that are employed to describe the present invention. Additionally, elements common between figures may retain the same numerical designation.

Figure 1:
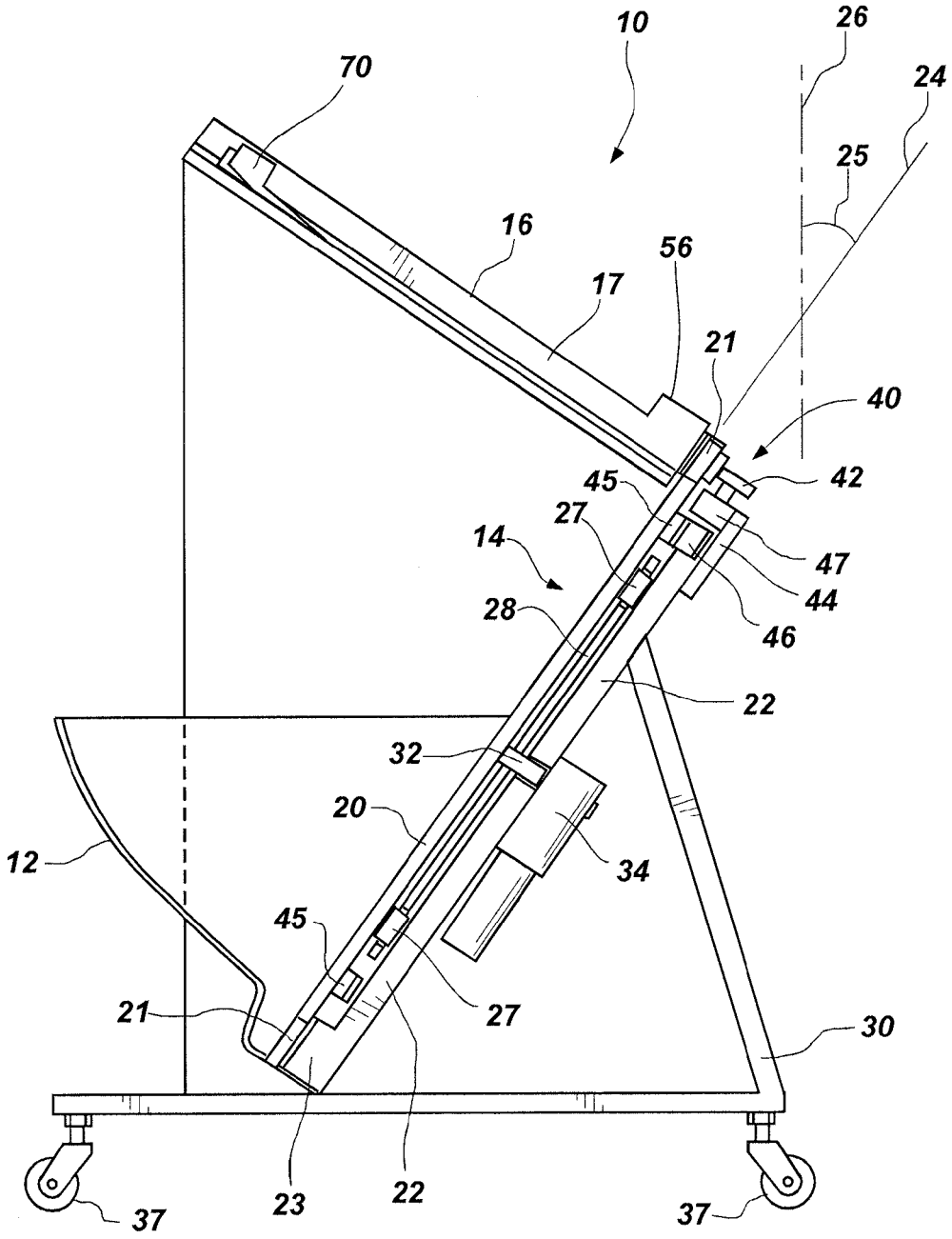
FIG. 1 is a cross-sectional side view of a chip-stacking device that embodies teachings of the present invention.

FIG. 1 is a cross-sectional side view of one example of a chip-stacking device 10 that embodies teachings of the present invention. The chip-stacking device 10 may include a container or hopper 12 for receiving unstacked chips, a chip stack carrier 16 for carrying one or more stacks of chips, a chip transport system 14 for transporting or carrying individual chips from the hopper 12 toward the chip stack carrier 16, and a chip ejector system 40 for ejecting or otherwise moving individual chips from the chip transport system 14 into one or more channels 17 of the chip stack carrier 16. The chip transport system 14 and chip ejector system 40 also may be used to count chips placed in the hopper 12, to sort chips placed in the hopper 12 by one or more identifying characteristics (e.g., color, size, shape, texture, or unique feature provided on a surface thereof), or to both sort and count chips placed in the hopper 12. The chip-stacking device 10 also may include one or more chip stack cutter devices 70 (similar to that shown in detail in FIGS. 6A-6E), which are discussed in further detail below, for cutting or displacing a selected number of chips from a stack of chips carried by the chip stack carrier 16 and presenting the selected number of chips in a manner that facilitates grasping and removal of the selected number of chips from the chip stack by a croupier or other person employing the chip-stacking device 10.

The height of the chip-stacking device 10 may be adjustable to accommodate different game table heights or different operator preferences. For example, caster wheels 37 that are adjustable in height optionally may be attached to the base frame 30.

As shown in FIG. 1, by way of example and not limitation, the chip transport system 14 may include a rotatable collection disc 20 and a stationary base plate 22, which may be structurally coupled to the base frame 30. The hopper 12 may be structurally coupled to the base plate 22 and/or the base frame 30. The collection disc 20 and the stationary base plate 22 each may be generally planar and oriented generally parallel to a plane 24 that is oriented at an acute angle 25 (e.g., about 45°) relative to a vertical axis 26 extending generally parallel to gravitational force. The collection disc 20 may be configured to selectively rotate relative to the stationary base plate 22. By way of example and not limitation, a plurality of roller bearings 27 may support the collection disc 20 over the stationary base plate 22. The roller bearings 27 may be held in place by a bearing plate 28, which may provide or define bearing races for the roller bearings 27. The center of the collection disc 20 may be structurally coupled to a drive shaft 32 of a gearbox driven by a motor 34, which may be mounted to the base plate 22 on a side thereof opposite the rotatable collection disc 20. In this configuration, the motor 34 may be used to drive rotation of the rotatable collection disc 20 about the central axis thereof. In additional embodiments, the collection disc 20 may be rotated by other means including, for example, one or more stepper motors, or a manually operated handle or crank.

In additional embodiments, the drive shaft 32 may have a strength sufficient to support the entire weight of the collection disc 20 and any load applied thereto (e.g., by chips in the hopper 12). In such a configuration, the collection disc 20 may be sufficiently rigid to eliminate any need for the roller bearings 27 and bearing plate 28.

The rotatable collection disc 20 may have a plurality of chip slots 21 that are each sized and configured for receiving a chip therein. By way of example and not limitation, the chip slots 21 may include recesses extending into the collection disc 20 (as shown in FIG. 1), spaces adjacent the surface of the collection disc 20 defined by protrusions (e.g., pegs or ridges) extending from the surface of the collection disc 20, or any other space on or in the collection disc 20 that is sized and configured for receiving one chip therein. For example, chips to be sorted and stacked by the chip-stacking device 10 may have a substantially circular shape, and the chip slots 21 in the collection disc 20 also may have a substantially circular shape. Furthermore, the diameter of the chip slots 21 may be slightly greater than the diameter of the largest chip to be sorted and stacked by the chip-stacking device 10.

As shown in FIG. 1, in some embodiments, the chip slots 21 may be positioned proximate a peripheral edge of the collection disc 20. The chip slots 21 may be substantially evenly circumferentially distributed about the collection disc 20. In other words, a predetermined substantially uniform circumferential spacing may separate adjacent chip slots 21 in the collection disc 20.

In some embodiments, the chip slots 21 may comprise apertures that each extend entirely through the collection disc 20 between the opposing major surfaces thereof. In other words, the depth or thickness of the chip slots 21 may be substantially equal to the thickness of the collection disc 20. In such embodiments, the base plate 22 may have an annular projection 23 that extends around a substantial portion of the base plate 22 along the angular path traveled by the chip slots 21 in the collection disc 20 to support the chips in the chip slots 21 and to prevent the chips from falling out from the chip slots 21 in the collection disc 20 due to gravity. In such embodiments, any chips carried by the collection disc 20 within the chip slots 21 may slide on the base plate 22 as the collection disc 20 rotates relative to the base plate 22.

In additional embodiments, the chip slots 21 may comprise recesses, or substantially blind holes, that do not extend entirely through the collection disc 20. In other words, the chip slots 21 may each comprise an open end on a side of the collection disc 20 facing the hopper 12 and a substantially closed end on a side of the collection disc 20 facing the base plate 22. In such embodiments, an annular circumferential groove, slot or other relatively smaller aperture 29 (FIGS. 2 and 3) may communicate with each chip slot 21 from the side of the collection disc 20 facing the base plate 22 to allow the chip ejector system 40 to eject the chips from the chip slots 21, as discussed in further detail below.

In some embodiments, the depth or thickness of the chip slots 21 may be equal to or greater than a thickness of the thickest chips (not shown in FIG. 1) to be sorted using the chip-stacking device 10.

Figure 2:
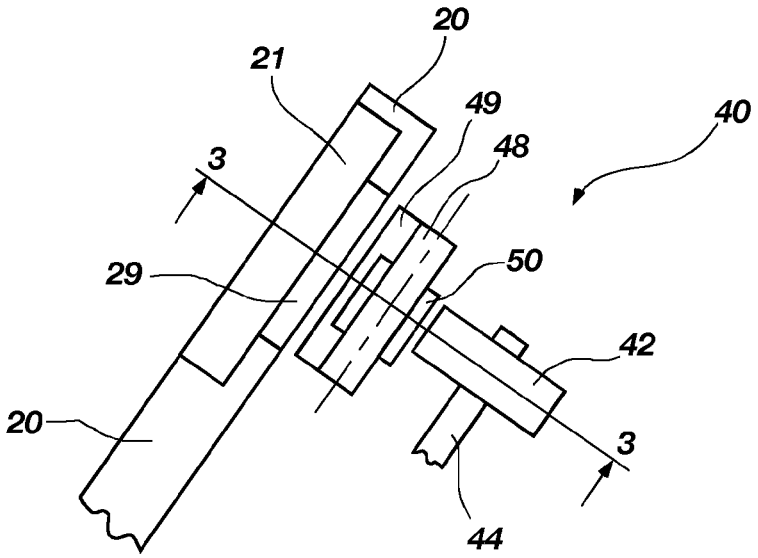
FIG. 2 is an enlarged partial cross-sectional view of a portion of the chip-stacking device shown in FIG. 1 illustrating various components of a chip ejector system that may be used to stack chips.
Figure 3:
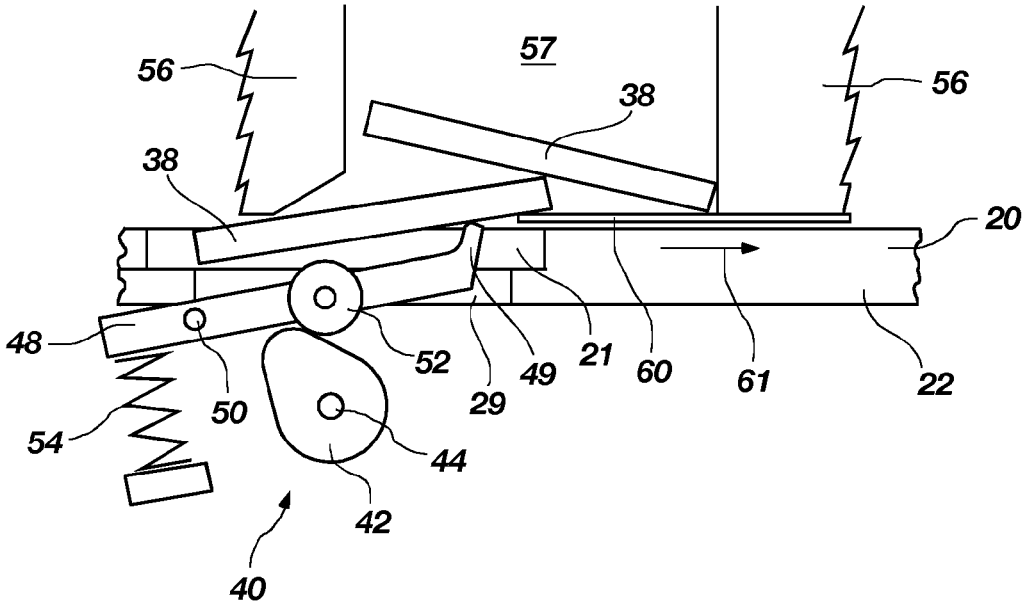
FIG. 3 is an enlarged cross-sectional view of the various components of the chip ejector system shown in FIG. 2 taken along section line 3-3 therein, and further illustrating a chip being ejected from a rotating disc into a chip stack carrier by the chip ejector system.

FIG. 2 is an enlarged partial view of the top end of the chip transport system 14 shown in FIG. 1 and illustrates various components of one embodiment of a chip ejector system 40 that may be used to eject or otherwise move chips 38 (FIG. 3) from the chip transport system 14 to the chip stack carrier 16 (FIG. 1). FIG. 3 is a cross-sectional view of the various components of the chip ejector system 40 shown in FIG. 2, and further illustrating a chip 38 being ejected from a chip slot 21 in the collection disc 20 into an aperture 57 of a chip transfer member 56, which leads to or extends from a channel 17 of a chip stack carrier 16 (FIG. 1). The chip-stacking device 10 may include a plurality of chip ejector systems 40, each corresponding to one channel 17 of the chip stack carrier 16 (FIG. 1). Only one chip ejector system 40 is shown in FIGS. 2 and 3 to simplify illustration thereof.

Referring in combination to FIGS. 2 and 3, the chip ejector system 40 may include an ejector cam 42, which may be mounted on a rotatable ejector cam shaft 44 on a side of the collection disc 20 opposite the chip stack carrier 16 (FIG. 1) (which is not shown in FIG. 2 to simplify the illustration). The chip ejector system 40 may further include an ejector arm 48, which may be mounted adjacent the ejector cam 42 and configured to pivot about a pivot point or pin 50 (FIG. 3). In some embodiments, a roller wheel 52 may be mounted on the ejector arm 48 adjacent the ejector cam 42. In this exemplary configuration, as the ejector cam 42 spins about the ejector cam shaft 44, the ejector cam 42 abuts against the roller wheel 52, which rolls along or across the surface of the ejector cam 42 as the ejector cam 42 rotates to reduce or eliminate friction therebetween, to reduce wear on the ejector cam 42 and/or the ejector arm 48, and to provide smooth operation. As shown in FIG. 3, the ejector cam 42 may have a size and an asymmetrical shape configured to cause the ejector arm 48 to pivot about the pivot point 50 back and forth between a first position and a second position as the roller wheel 52 rolls along the exterior surface of the rotating ejector cam 42. In the first position of the ejector arm 48, an end 49 of the ejector arm 48 may be substantially retracted from the chip slot 21 in the collection disc 20. In the second position of the ejector arm 48, the end 49 of the ejector arm 48 may extend at least partially into a chip slot 21 in the collection disc 20, as shown in FIG. 3, causing a lifting of a chip in the chip slot 21. In some embodiments, the end 49 of the ejector arm 48 may extend through the relatively smaller slot or aperture 29 and at least partially into a chip slot 21 in the collection disc 20 in the second position.

A spring member 54 may be used to bias the ejector arm 48 in the first position thereof, in which the ejector arm 48 is substantially retracted from the chip slot 21 in the collection disc 20.

Referring again to FIG. 1, the ejector cam shaft 44 may be rotated or spun by, for example, providing an annular ring gear 45 on the side of the collection disc 20 facing the chip ejector system 40 (i.e., the side of the collection disc 20 opposite the hopper 12). The annular ring gear 45 may be configured to selectively engage and drive a pinion 46 that is structurally coupled to, or otherwise operatively associated with, the ejector cam shaft 44. An actuating device 47, such as, for example, a magnetic coupling, an electrically operated solenoid, or a pneumatically or hydraulically operated drive element may be used to provide the selective engagement between the annular ring gear 45 and the pinion 46. A microprocessor, which may comprise or be part of a computer system (not shown) configured to control one or more components of the chip-stacking device 10, may be used to selectively operate the actuating device 47 and is described in further detail below. Such a computer system may include, for example, an application specific integrated circuit (ASIC), a programmable logic controller, a desktop computer, a portable computer, etc. In this configuration, the ejector cam 42 may perform substantially the same movement relative to the collection disc 20 independent of the speed of rotation of the collection disc 20. In other words, the speed of rotation of the ejector cam 42 may be defined by (or substantially a function of) the speed of rotation of the collection disc 20.

In additional embodiments, an electrically, pneumatically, or hydraulically operated drive may be used to cause the ejector arm 48 to move back and forth between the first and second positions. In yet other embodiments, such an electrically, pneumatically, or hydraulically operated drive may be used as the ejector itself to directly act upon each chip 38 and eject the chips 38 from the chip slot 21 in the collection disc 20.

Figure 4:
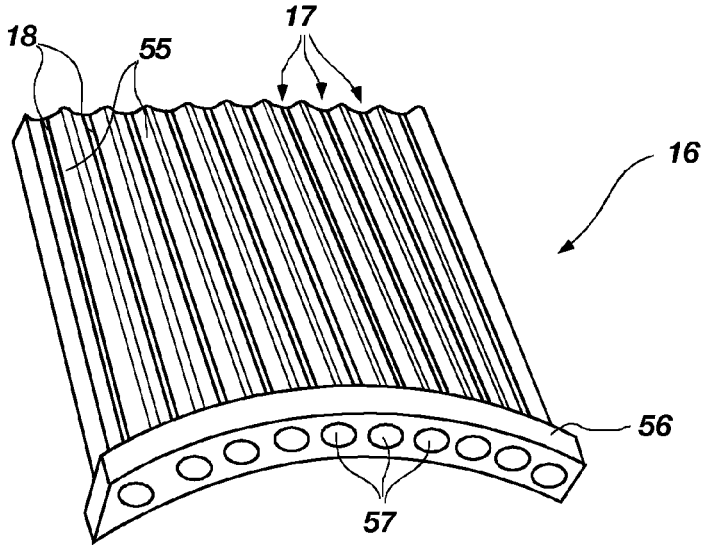
FIG. 4 is a perspective view of one example of a chip stack carrier that may be used for carrying stacks of chips that have been stacked by the chip-stacking device that may be used as part of the chip-stacking device shown in FIG. 1 for carrying stacks of chips that have been stacked by the chip-stacking device.

FIG. 4 is a perspective view of one embodiment of a chip stack carrier 16 that may be used as part of the chip-stacking device 10 shown in FIG. 1. The chip stack carrier 16 may include one or more channels 17 that are each configured to support, contain, or otherwise carry one stack of chips 38 (FIG. 3). As shown in FIG. 4, for example, the channels 17 may comprise a semi-cylindrical cup-shaped or U-shaped region 55 on a surface of the chip stack carrier 16 that is configured to support a generally cylindrical stack of round chips 38 (FIG. 3). In additional embodiments, the channels 17 may be defined by mutually parallel extending, suitably three-dimensionally spaced rods or ridges for supporting a stack of chips thereon. In yet other embodiments, the channels 17 may comprise a generally tubular structure having an opening therein to allow at least some of the chips 38 in a stack of chips 38 to be removed from the chip stack carrier 16. In the non-limiting example embodiment shown in FIG. 4, the chip stack carrier 16 includes ten semi-cylindrical cup-shaped channels 17.

In some embodiments, the chip stack carrier 16 may further include a chip delivery or chip transfer member 56 provided at a lower end of the chip stack carrier 16 adjacent the collection disc 20. The chip transfer member 56, in one example embodiment of the invention, is arcuate, and may include a plurality of apertures 57 extending therethrough that are each aligned with and correspond to a single channel 17 of the chip stack carrier 16. The apertures 57 of the chip transfer member 56 may have a size and shape substantially corresponding to the size and shape of a stack of the chips 38 (FIG. 3). In some embodiments, the chip transfer member 56 may be integrally formed with the chip stack carrier 16. In other embodiments, the chip transfer member 56 may comprise a separate member that is structurally coupled to the chip stack carrier 16. The chip transfer member 56 may be used to provide additional support and alignment to a chip 38 as the chip 38 enters into the chip stack carrier 16 to ensure that the chip 38 is accurately and properly stacked therein.

Referring again to FIG. 1, the chip stack carrier 16 and the chip transfer member 56 may be structurally coupled or mounted to the base frame 30 such that the chip transfer member 56 is positioned adjacent the collection disc 20 and the apertures 57 (FIG. 4) of the chip transfer member 56 are aligned with the chip slots 21 in the collection disc 20. In some embodiments, the chip stack carrier 16 may be oriented generally perpendicular to the collection disc 20 (i.e., at an angle of about 90° relative to the collection disc 20).

To use the chip-stacking device 10 to stack chips 38 (FIG. 3) in the chip stack carrier 16, unstacked chips 38 may be collected and placed into the hopper 12. As the chips 38 accumulate in the bottom of the hopper 12, the chips 38 may fall individually into the chip slots 21 within the collection disc 20. As the collection disc 20 rotates about the drive shaft 32 (FIG. 1), the chips 38 may be carried past one or more sensors (not shown in the figures), each of which may be configured to identify a particular characteristic of the passing chips 38. For example, the one or more sensors may include a spectrometer configured to detect a peak wavelength of electromagnetic radiation (e.g., light) reflected from each respective chip 38. Such radiation may be within or outside the visible region of the electromagnetic radiation spectrum. In other words, the one or more sensors may include a spectrometer configured to detect the color of each respective chip 38. Alternatively, the one or more sensors may include a sensor configured to detect a size of each chip, a shape of each chip, a texture of each chip, a unique identifying feature provided on a surface of each chip, or any other identifying characteristic or feature of each chip.

As the one or more sensors detect and identify one or more distinguishing features and/or characteristics, a signal may be communicated from the one or more sensors to a microprocessor. The microprocessor may be configured (under control of a software program) to identify which particular chip ejector system 40 should be actuated to eject each respective chip 38 into a corresponding channel 17 of the chip stack carrier 16 that has been aligned with the selected chip slot 21 and designated to carry chips 38 that exhibit the distinguishing features and/or characteristics exhibited by each respective chip 38. The microprocessor also may be configured (under control of the software program) to determine, considering the speed of rotation of the collection disc 20, when to actuate and de-actuate the identified corresponding chip ejector system 40 so as to cause that particular chip ejector system 40 to eject the chip 38 into the corresponding channel 17 (FIG. 4) of the chip stack carrier 16 assigned to the respective particular chip type without ejecting other chips 38 into that corresponding channel 17.

Referring again to FIG. 3, as a chip 38 is carried past the chip ejector system 40 corresponding to the appropriate channel 17 of the chip stack carrier 16 (FIG. 1) (and, optionally, the corresponding aperture 57 extending through the chip transfer member 56), the microprocessor may initiate an actuating device 47 to cause a pinion 46 (FIG. 1) to engage an annular ring gear 45 on the rotating collection disc 20, which may cause the corresponding cam shaft 44 to rotate and spin the corresponding ejector cam 42 that is structurally coupled thereto. Rotation of the ejector cam 42 causes the ejector arm 48 to move from the first position to the second position in which the end 49 of the ejector arm 48 lifts, pushes, or otherwise ejects the leading end of the chip 38 out from the chip slot 21 of the collection disc 20 over a blade or finger 60 positioned between the collection disc 20 and the channel 17 of the chip stack carrier 16 and into the appropriate channel 17 of the chip stack carrier 16 (or, optionally, the corresponding aperture 57 extending through the chip transfer member 56). A plurality of blades or fingers 60 may be secured to the end of the chip transfer member 56 facing the collection disc 20, each corresponding to one channel 17 of the chip stack carrier 16 (or, optionally, each partially extending over one aperture 57 of the chip transfer member 56). As the chip 38 is lifted or ejected out from the chip slot 21 of the collection disc 20 over a blade or finger 60, any chips 38 already present in the channel 17 (or aperture 57) may be lifted upwards or otherwise forced upwardly and away from the collection disc 20 to make room for the additional newly added chip 38, as shown in FIG. 3. As the collection disc 20 continues to rotate in the direction indicated by the directional arrow 61 as shown in FIG. 3, the chip 38 is caused to pass entirely out from the chip slot 21 of the collection disc 20 and into the channel 17 of the chip stack carrier 16 (or, optionally, the aperture 57 of the chip transfer member 56), the chip 38 may rest upon and be supported by the blade or finger 60 until another chip 38 is inserted below the previously ejected chip 38.

The above-described process may be repeated as long as chips 38 exhibiting similar identifying features and/or characteristics are being conveyed by the collection disc 20, and until the channels 17 of the chip stack carrier 16 are filled with a selected number of chips 38. Optionally, a chip sensor or chip counter may be used to detect or count the number of chips 38 in each channel 17 of the chip stack carrier 16 to enable the microprocessor to automatically cease rotation of the collection disc 20 when one or more channels 17 of the chip stack carrier 16 are filled with a selected number of chips 38, as described in further detail below.

In some embodiments, the microprocessor may be configured (under control of a software program) to monitor one or more features or operating characteristics of the chip-stacking device 10 to determine whether chips 38 are becoming jammed or stuck in any area of the chip-stacking device 10. For example, the current load drawn by the motor 34 may be monitored to identify a jam. In additional embodiments, movement of the collection disc 20 may be monitored or queried directly using a suitable sensor to identify a jam. If the microprocessor determines that a jam has in fact occurred or is occurring, the microprocessor may be configured (under control of a software program) to cause a return motion of the collection disc 20 (i.e., to reverse the direction of rotation of the collection disc 20) for a sufficient amount of time or over a sufficient angle of rotation to free the detected jam.

Furthermore, in some embodiments of the present invention, the microprocessor may be configured (under control of a software program) to adjust the speed of rotation of the collection disc 20 at least partially as a function of the number of chips 38 in the hopper 12 or the number of chips 38 detected in the chip-slots 21 of the chip collection disc 20. In other words, the speed of operation of the chip-stacking device 10 may be substantially automatically increased when relatively more chips 38 are detected in the chip-stacking device 10, and the speed of operation of the chip-stacking device 10 may be substantially automatically decreased (or even stopped) when relatively fewer chips 38 are detected in the chip-stacking device 10. For example, the speed of operation of the chip-stacking device 10 may be set depending on whether and how many chip slots 21 in the collection disc 20 are not filled with a chip 38, as detected by the previously described chip sensors (not shown). By changing the speed of operation of the chip-stacking device 10 based on the number of chips 38 detected in the device, wear of the moving parts of the chip-stacking device 10 may be reduced, and the performance of the chip-stacking device 10 may be enhanced.

Once the chip-stacking device 10 has stacked a plurality of chips 38 in the one or more channels 17 of the chip stack carrier 16, a croupier or other person using the chip-stacking device 10 may draw or remove stacks of chips 38 from the chip stack carrier 16 as needed. To facilitate removal of chips 38 from the chip stack carrier 16, the chip-stacking device 10 may be provided with a chip stack cutter device for presenting a predetermined number of chips 38 in a chip stack carried by the chip stack carrier 16 to a person in a manner that facilitates quick and easy removal of the predetermined number of chips 38.

Figure 5:
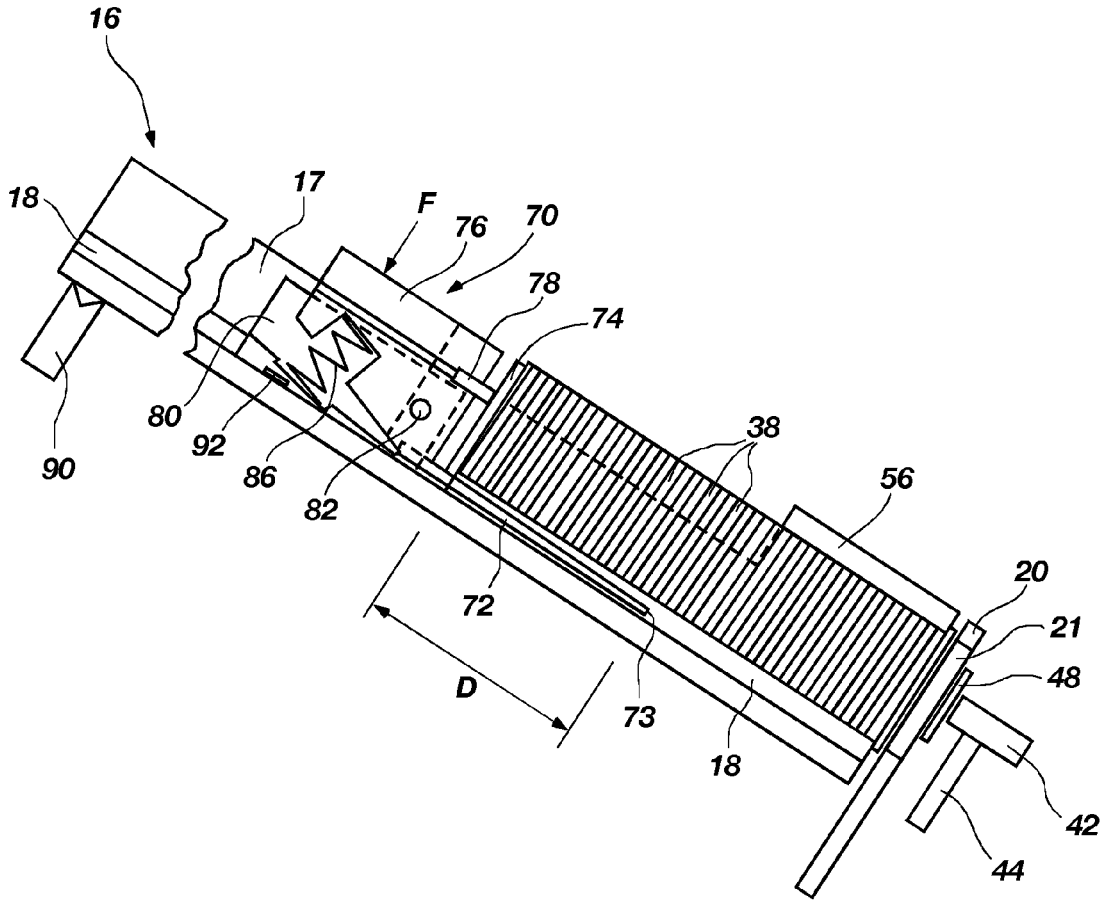
FIG. 5 is a cross-sectional side view of the chip stack carrier shown in FIG. 4 and further illustrating a stack of chips in the chip stack carrier and one example of a chip stack cutter device that embodies teachings of the present invention and that may be used to cut or displace a selected number of chips from the chip stack.

FIG. 5 is a cross-sectional view of the chip stack carrier 16 (FIG. 4) of the chip-stacking device 10 (FIG. 1) illustrating one example of an embodiment of a chip stack cutter device 70 that may be used with the chip stack carrier 16 and that also embodies teachings of the present invention.

As shown in FIG. 5, in some embodiments of the present invention, each channel 17 of the chip stack carrier 16 may include a groove 18, which may longitudinally extend down the center of the channel 17. At least a portion of the chip stack cutter device 70 may be configured to slide or glide within the groove 18. For example, the chip stack cutter device 70 may include a base member 80, at least a portion of which is configured to slide or glide within the groove 18. Furthermore, the chip stack cutter device 70 may be configured such that the chip stack cutter device 70 slides downward in the chip stack carrier 16 due to gravity so as to constantly abut against any stack of chips 38 in the channel 17 of the chip stack carrier 16. In this configuration, the chip stack cutter device 70 rises or slides upward in the channel 17 with the stack of chips 38 as the chips 38 are stacked in the channel 17. In some embodiments, only the force applied by the chips 38 lifts or pushes the chip stack cutter device 70 upward in the channel 17 of the chip stack carrier 16. In some embodiments, a roller mechanism (e.g., roller bearings) (not shown) may be provided on or in chip stack cutter device 70 to facilitate sliding of the chip stack cutter device 70 within the groove 18 and/or channel 17 of the chip stack carrier 16. In additional embodiments, the chip stack cutter device 70 may include a spring member (not shown) that is configured to bias the chip stack cutter device 70 downward in the chip stack carrier 16 so as to constantly abut against any stack of chips 38 in the channel 17 of the chip stack carrier 16.

In the embodiment shown in FIG. 5, the chip stack cutter device 70 includes an elongated chip displacement member or displacement member 72 that extends below the chips 38 (or otherwise adjacent a lateral surface of the stack of chips 38) in the groove 18 extending along the channel 17 of the chip stack carrier 16. An adjustable chip stop member 74 may be configured to abut against the top or leading chip 38 in the stack of chips 38, and may be structurally coupled to an actuating lever member 76 by an adjustable screw 78. The displacement member 72 also may be structurally coupled to the lever member 76. In some embodiments, the displacement member 72 may be integrally formed with the lever member 76. In other words, the displacement member 72 may comprise an integral part of the lever member 76 that projects from the lever member 76. The lever member 76 (and, hence, the displacement member 72 and the chip stop member 74) may be connected to the base member 80 of the chip stack cutter device 70 using a shaft or pin 82. In this configuration, the lever member 76 may be configured to pivot or swivel relative to the base member 80 back and forth between a first position and a second position. In the first position, which is shown in FIG. 5, the displacement member 72 may be positioned within the groove 18 below the chips 38. In the second position (not shown), at least a portion of the displacement member 72 may be disposed outside the groove 18 and may abut against the lateral surfaces of the chips 38 that together define the lateral surface of the chip stack, which may cause a selected number of chips 38 positioned over the displacement member 72 to be lifted, pushed, or otherwise displaced in a lateral direction relative to the channel 17 and/or other chips 38 in the chip stack outwards away from the chip stack carrier 16. In this configuration, at least a portion of a major surface of the lower or bottommost chip 38 in the number of chips 38 that has been lifted, pushed, or otherwise displaced by the displacement member 72 is exposed, which allows the croupier or other person employing the chip-stacking device 10 to grasp the displaced chips 38 by grasping at least a portion of an exposed major surface of both the top or uppermost chip 38 and the bottom or lowermost chip 38 in the number of chips 38 that has been lifted, pushed, or otherwise displaced by the displacement member 72.

The actuating lever member 76 and displacement member 72 optionally may be biased to the first position using a spring 86 or other biasing element positioned between the lever member 76 and the base member 80, as shown in FIG. 5. To move the lever member 76 and displacement member 72 from the first position to the second position, a force F may be applied to the lever member 76 against the force of the spring 86 to cause the lever member 76 and displacement member 72 to pivot about the pin 82. The force F may be applied manually by a croupier or other person using the chip-stacking device 10 using, for example, one or more digits of the hand. In the second position, the chips 38 displaced by the displacement member 72 of the chip stack cutter device 70 are separated from the other chips 38 in the chip stack and presented in a manner that facilitates quick and accurate removal of a selected number of chips 38 from the chip stack.

The number of chips 38 positioned over the displacement member 72 of the chip stack cutter device 70, and hence, the number of chips 38 in the chip stack that are displaced by the chip stack cutter device 70 when a force is applied to the actuating lever member 76 as previously described, is determined by the distance D (FIG. 5) that separates the distal end 73 of the displacement member 72 from the chip-facing surface of the chip stop member 74. The number of chips 38 in the chip stack that will be displaced by the chip stack cutter device 70 may be estimated by dividing the distance D by the average thickness of the chips 38.

The distance D may be selectively adjusted using the adjustable screw 78 to move the chip stop member 74 relative to the lever member 76. By way of example and not limitation, the chip stack cutter device 70 may be configured to displace about twenty (20) chips 38 when a force F is applied to the lever member 76. Furthermore, in some embodiments, the distance D may be selectively adjusted to be an integer multiple of the average thickness of the chips 38.

In some embodiments, a sensor 90 may be associated with each of the channels 17 of the chip stack carrier 16. The sensor 90 may be used to determine when a maximum or other selected number of chips 38 have been positioned in the respective channel 17 of the chip carrier 16, and to prevent the placement of additional chips 38 therein. In some embodiments, as the chip stack cutter device 70 reaches an endpoint (i.e., the maximum amount of chips 38 have been placed in the respective channel 17), the sensor 90 may detect the presence or position of the chip stack cutter device 70 and send an electrical signal to the previously described microprocessor, which then may cause the chip-stacking device 10 to cease placing additional chips 38 into that particular channel 17 until chips 38 have been removed therefrom, and the sensor 90 is no longer actuated. The sensor 90 may be, for example, an optical sensor or a magnetic sensor. If the sensor 90 comprises a magnetic sensor, a permanent magnet 92 may be provided in the bottom of the chip stack cutter device 70 for actuating the sensor 90.

Figure 6A:
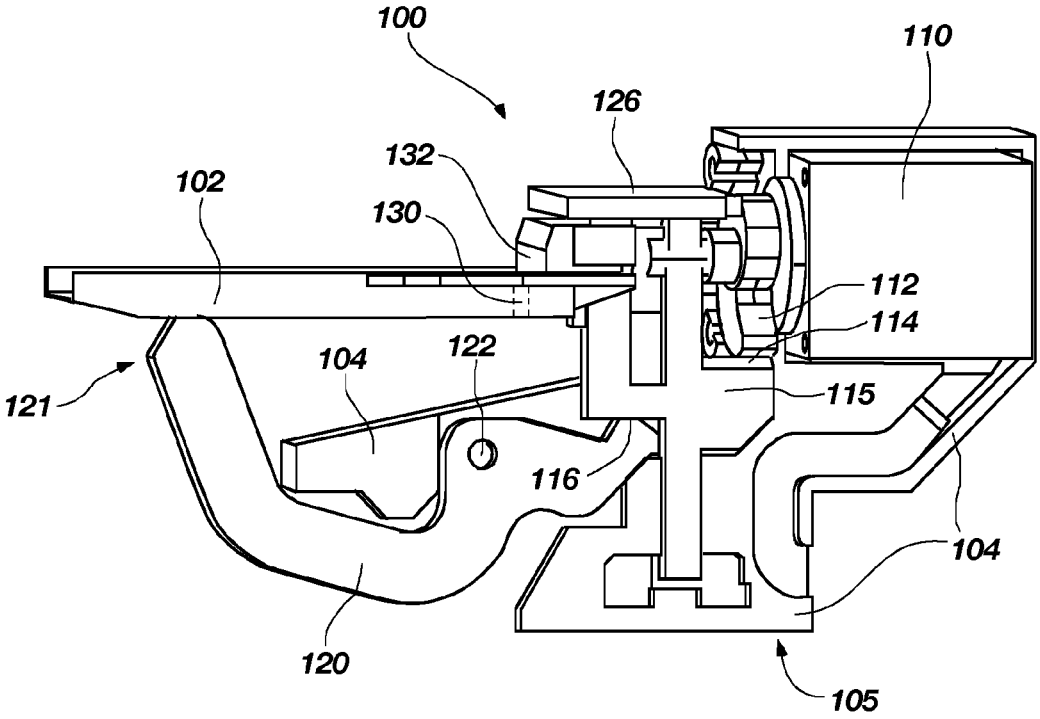
FIG. 6A is a partial cross-sectional perspective view of another example of a chip stack cutter device, shown in an actuated configuration, that embodies teachings of the present invention and that may be used to manually or automatically cut or displace a selected number of chips from a chip stack carried by a chip stack carrier, such as that shown in FIG. 4.
Figure 6B:
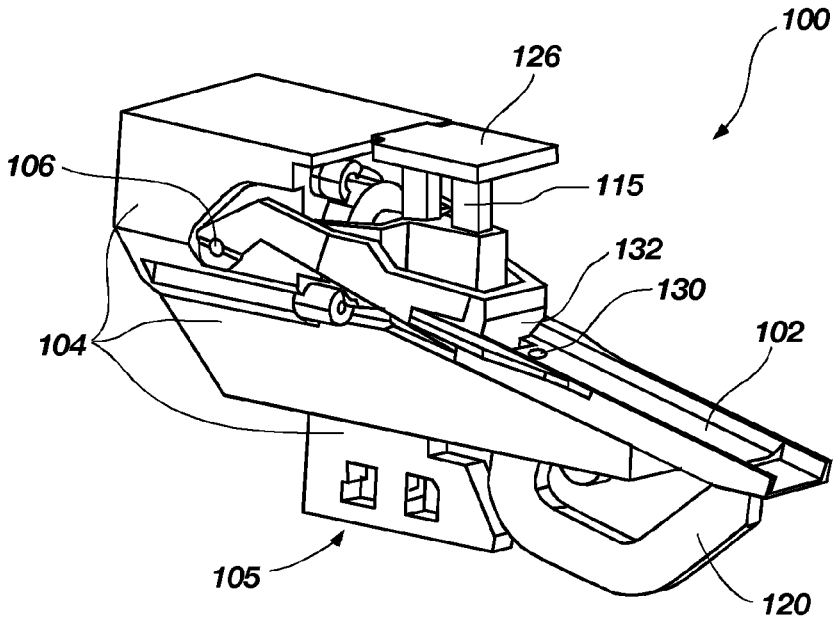
FIG. 6B is a perspective view of the cutter device shown in FIG. 6A, illustrating the cutter device in a non-actuated configuration.

Another cutter device 100 that also embodies teachings of the present invention is shown in FIGS. 6A and 6B. Referring to FIG. 6A, the cutter device 100 includes an elongated chip displacement member 102 that is pivotally mounted to a cutter base member 104. The displacement member 102 is configured to move or pivot relative to the cutter base member 104, and may be attached to the cutter base member 104 by a pin member 106 (FIG. 6B). The cutter device 100 may further include a selectively powerable, energy-responsive device for displacing a number of chips 38 in a stack of chips 38 (FIG. 3) carried in the channel 17 of the chip stack carrier 16 (FIG. 1). The energy-responsive device may comprise an electrical, electromechanical, pneumatic or hydraulic device. The energy-responsive device may be configured to selectively move the displacement member 102 relative to the cutter base member 104 (and, therefore, relative to a channel 17 in which the cutter device 100 may be disposed) in response to a signal received by the energy-responsive device (e.g., directly from a button, switch, sensor, or lever, or indirectly from such a device through a microprocessor).

By way of example and not limitation, the energy-responsive device may be or include a motor 110 (e.g., an electric stepper motor) that is configured to selectively rotate a cutter cam member 112. As the cutter cam member 112 rotates, the cutter cam member 112 may act against a cam bearing surface 114 of a rod member 115. As used herein, the term "rod member" means any member configured to move in a substantially linear direction for translating linear movement or for transforming non-linear movement (e.g., rotational movement) into linear movement. Rod members 115 may have any shape and are not limited to elongated shapes (e.g., elongated cylinders or bars). The rod member 115 may be secured within or to the base member 104 of the cutter device 100 and constrained to substantially linear movement (e.g., in the up and down or vertical directions of FIG. 6A) relative to the base member 104 of the cutter device 100. The rod member 115 may further include a surface 116 that is configured to abut against a surface of a lever 120. The lever 120 also may be attached to the base member 104 of the cutter device 100 and configured to pivot or rotate relative to the base member 104 of the cutter device 100. By way of example and not limitation, the lever 120 may be attached to the base member 104 of the cutter device 100 using a pin member 122. An end 121 of the lever 120 remote from the rod member 115 may be configured to abut against the displacement member 102, as shown in FIG. 6A.

The cutter device 100 may further include means for actuating the cutter device 100 (such as, for example, a sensor, button, lever, switch, etc.) and causing the motor 110 to selectively rotate the cutter cam member 112, as described in further detail below.

With continued reference to FIG. 6A, as the rod member 115 translates linearly in the downward direction of FIG. 6A (i.e., toward the bottom of FIG. 6A) upon rotation of the cutter cam member 112, the surface 116 of the rod member 115 may act upon the lever 120 and cause the lever 120 to pivot about the pin member 122. As the lever 120 pivots about the pin member 122, the end 121 of the lever 120 may abut against and lift or push the displacement member 102 in the upward direction of FIG. 6A. This motion of the displacement member 102 may be used to lift, push, move, or otherwise displace chips 38 in a chip stack that are positioned over the displacement member 102, as previously described in relation to the embodiment shown in FIG. 5.

Figure 6C:
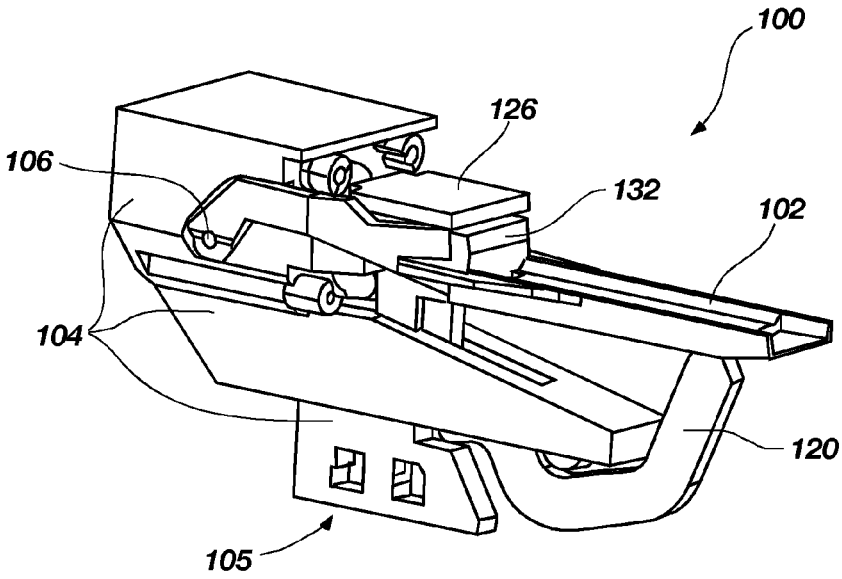
FIG. 6C is a perspective view of the cutter device shown in FIGS. 6A and 6B,illustrating the cutter device in an actuated configuration.

FIG. 6B is a perspective view of the cutter device 100 in a non-actuated configuration or position, and FIG. 6C is a perspective view of the cutter device 100 in an actuated configuration or position. As shown in FIGS. 6B and 6C, the base member 104 of the cutter device 100 may include a projection 105 or other feature, at least a portion of which may be configured to cooperate with and slide within a groove 18 extending along a channel 17 of a chip stack carrier 16, such as that shown in FIGS. 4 and 5. In some embodiments, a roller mechanism (e.g., roller bearings, not shown) may be provided on or in the projection 105 to facilitate sliding of the projection 105 or other feature of the base member 104 within the groove 18 and/or channel 17 of the chip stack carrier 16.

Figure 6D:
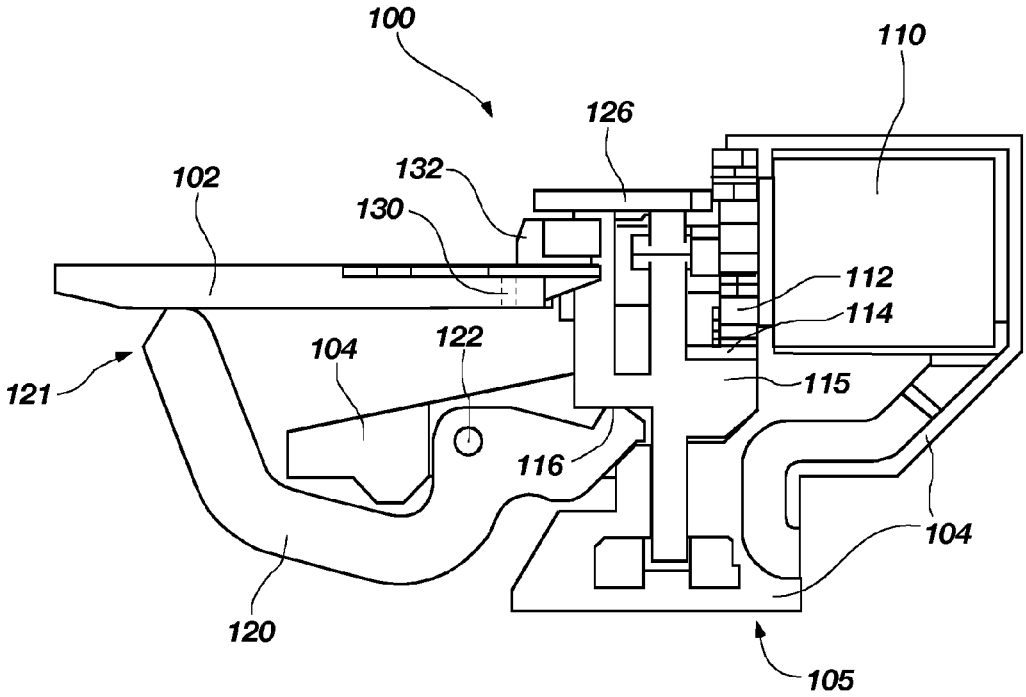
FIG. 6D is a cross-sectional side view of the cutter device shown in FIGS. 6A through 6C, illustrating the cutter device in an actuated configuration.
Figure 6E:
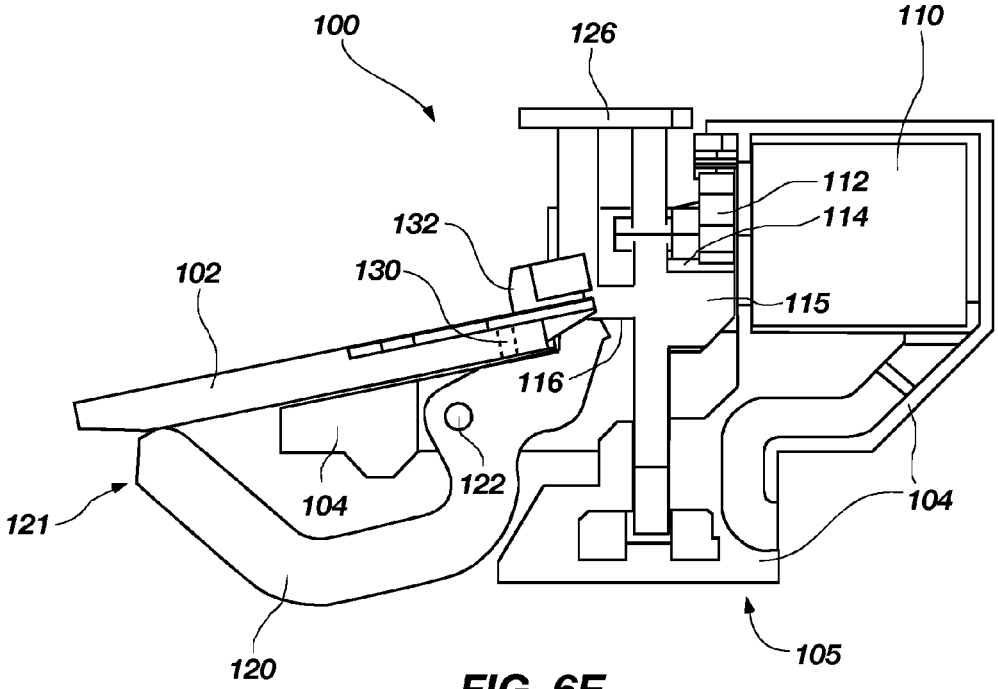
FIG. 6E is a cross-sectional side view of the cutter device shown in FIGS. 6A through 6D, illustrating the cutter device in a non-actuated configuration.

FIG. 6D is a cross-sectional side view of the cutter device 100 in the actuated configuration or position. As previously discussed, upon actuation of the cutter device 100, the motor 110 may cause the cutter cam member 112 to rotate to a position at which the cutter cam member 112 has moved or displaced the rod member 115 in a downward direction, causing the lever 120 to pivot and lift or displace the displacement member 102.

The motor 110 may be actuated using actuating means including, for example, a sensor, button, switch, lever, etc. By way of example and not limitation, a sensor 130 may be provided that is configured to detect when a selected number of chips 38 (FIG. 3) are disposed in or above the displacement member 102. For example, the sensor 130 may be provided in or on the displacement member 102 and configured to detect or sense when a chip 38 (FIG. 5) is located adjacent the chip stop member 132 of the cutter device 100, which may indicate that a maximum number of chips 38 is disposed on or over the displacement member 102. The sensor 130 may include, for example, an optical sensor, proximity sensor or any other sensor capable of detecting the presence of a chip 38 in a selected location. The sensor 130 may communicate an electrical signal to a microprocessor configured to communicate with the motor 110, and the microprocessor may send a signal to the motor 110 to cause the motor 110 to actuate and rotate the cutter cam member 112 upon receiving the electrical signal from the sensor 130. Each cutter device 100 of a chip-stacking device may have a separate microprocessor or computer system configured to control each respective cutter device 100, and each separate microprocessor or computer system optionally may be configured to communicate electrically with a main microprocessor or computer system of the chip-stacking device. In such a configuration, each cutter device 100 may be operated substantially independently from other cutter devices 100 of a chip-stacking device.

The cutter device 100 may be configured to maintain the actuated configuration or position until the sensor 130 detects or senses that the chips 38 that have been moved or displaced by the displacement member 102 have been removed by a croupier or other person or device using the cutter device 100. Upon removal of the chips 38 from the displacement member 102, the sensor 130 may send a signal (e.g., an electrical signal) to the microprocessor, which in turn may send a signal to the motor 110 to cause the motor 110 to rotate the cutter cam member 112 and move the cutter device 100 from the actuated position (FIG. 6C) to the non-actuated position (FIG. 6B).

In additional embodiments, the motor 110 may be configured to be actuated when a croupier or other person using the cutter device 100 triggers a sensor, button, switch, or lever provided on the base member 104 (or other feature) of the cutter device 100. For example, a proximity sensor may be provided on the cutter device 100 that is configured to actuate the motor 110 when a croupier (or other person) moves their hand proximate the cutter device 100. In yet other embodiments, the motor 110 of the cutter device 100 may be actuated remotely using a sensor, button, switch, or lever that is remotely located relative to the cutter device 100. In such embodiments, a signal may be transmitted from the remote sensor, button, switch, or lever to the motor 110 of the cutter device 100 over electrical wires or wirelessly via electromagnetic radiation (e.g., infrared radiation, radio waves, laser radiation, etc.). By way of example and not limitation, a remote pedal device (not shown), which may be actuated using the foot of a croupier (or other person), may be used to remotely actuate the motor 110. In such additional embodiments, the cutter device 100 may be configured to remain in the actuated configuration until chips 38 (FIG. 5) displaced by the displacement member 102 have been removed from the chip stack carrier 16 (FIG. 1). In additional embodiments, the cutter device 100 may be configured to remain in the actuated configuration for a predetermined amount of time before returning to the non-actuated configuration. In yet other embodiments, the cutter device 100 may be configured to maintain the actuated configuration only until a button, switch, or sensor used to actuate the cutter device 100 is itself de-actuated.

In some embodiments, the cutter device 100 may be biased toward the non-actuated configuration. For example, the weight of the displacement member 102 itself may be sufficient to cause the lever 120 to pivot and force the rod member 115 in the upward direction of FIG. 6D. In other embodiments, a spring member may be used to bias the cutter device 100 towards the non-actuated configuration.

In the embodiment shown in FIGS. 6A through 6E, the cutter device 100 may be operated either automatically using the motor 110, or manually by simply pressing the platform button 126 and forcing the linear motion rod member 115, which is structurally coupled thereto, in the downward direction. Such a configuration may be useful, for example, to allow continued use of the cutter device 100 should the motor 110, sensor 130, or other element of the cutter device 100 malfunction.

In some embodiments, the cutter device 100 may include an additional sensor (not shown) that is configured to sense or detect a position of at least one of the displacement member 102, the cutter cam member 112, the rod member 115, and the lever 120. Such an additional sensor may be configured to communicate electrically with a microprocessor or computer system for controlling the cutter device 100, and may be used to ensure that the motor 110 has completely lifted or pushed the displacement member 102 from a first position to a second position upon actuation of the cutter device 100, and that the displacement member 102 has completely returned to the first position upon de-actuation of the cutter device 100. Such an additional sensor may be used to minimize and/or correct any operation errors of malfunctions of the cutter device 100.

A cutter device 100 that embodies teachings of the present invention, such as that shown in FIGS. 6A through 6E, may be provided in one or more of the channels 17 of a chip stack carrier (such as that shown in FIG. 4) to provide a chip-stacking device that embodies teachings of the present invention.

Figure 7:
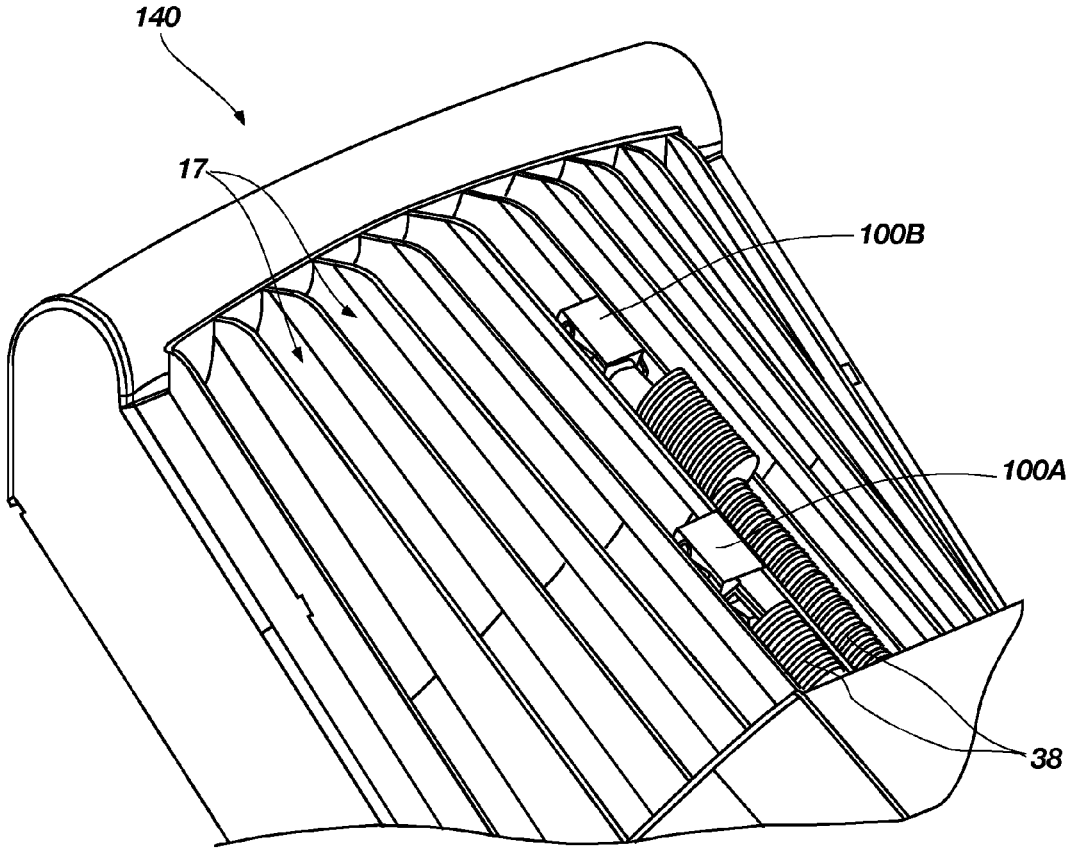
FIG. 7 is a perspective view of another example of a chip stack carrier, like that shown in FIG. 4, illustrating a plurality of cutter devices, like those shown in FIGS. 6A through 6E, disposed in channels of the chip stack carrier.

FIG. 7 is a perspective view of another embodiment of a chip stack carrier 140, similar to the chip stack carrier 16 shown in FIGS. 1 and 4, illustrating a first cutter device 100A disposed in one channel 17 of the chip stack carrier 140, and a second cutter device 100B disposed in another channel 17 of the chip stack carrier 140. The first cutter device 100A and the second cutter device 100B are both substantially identical to the chip cutter device 100 previously described with reference to FIGS. 6A through 6E. Chips 38 are shown in both of the channels 17 including the cutter devices 100A, 100B.

As can be seen in FIG. 7, the number of chips 38 in the channel 17 in which the cutter device 100A is disposed is less than the predetermined number of chips 38 the cutter device 100A is configured to displace. As a result, the cutter device 100A is illustrated in the non-actuated configuration or position. In contrast, the number of chips 38 in the channel 17 in which the cutter device 100B is disposed is greater than the predetermined number of chips 38 the cutter device 100B is configured to displace. As a result, the cutter device 100B is illustrated in the actuated configuration or position, in which the predetermined number of chips 38 is displaced laterally outwards relative to other chips 38 in the stack of chips 38. In this configuration, the chips 38 displaced by the cutter device 100B are presented in a manner that facilitates quick and accurate removal of the selected number of chips 38 by a croupier or other person using the chip-stacking device 10 (FIG. 1).

Furthermore, as will be understood with reference to FIG. 7, some of the chips 38 in a stack of chips 38 in a channel 17 of the chip carrier device 140 may be displaced by the cutter device 100A, 100B relative to other chips 38 in the stack even when the cutter device 100A, 100B is in a non-actuated configuration like that of the first cutter device 100A. However, such displaced chips may not comprise a predetermined selected number of chips to be displaced by the cutter device 100A, 100B, and they may not be displaced or presented in a manner that facilitates quick and accurate removal of the selected number of chips 38 by a croupier or other person using the chip-stacking device 10 (FIG. 1).

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A method of displacing chips in a chip stack, comprising:

extending an elongated displacement member under a number of chips in a stack of chips carried by a channel of a chip stack carrier;

moving an actuating lever member relative to a base member, the actuating lever member movably coupled relative to the base member; and displacing the number of chips in the stack of chips relative to the channel using the elongated displacement member responsive to movement of the actuating lever member.

2. The method of claim 1, further comprising biasing the actuating lever member to a first position relative to the base member in which the elongated displacement member extends under the number of chips in the stack of chips carried by the chip stack carrier without displacing at least some of the number of chips relative to other chips in the stack of chips.

3. The method of claim 2, wherein biasing the actuating lever member to the first position comprises biasing the actuating lever member to the first position using a spring member.

4. The method of claim 1, wherein moving the actuating lever member comprises pivoting the actuating lever member relative to the base member.

5. The method of claim 1, further comprising adjusting a maximum number of chips displaceable by the elongated displacement member using an adjustable chip stop member coupled to the actuating lever member.

6. The method of claim 1, further comprising determining whether a maximum number of chips has been positioned in the channel by detecting a permanent magnet attached to at least one of the base member, the actuating lever member, and the elongated displacement member using a magnetic sensor associated with the chip stack carrier.

7. A method of cutting a stack of chips, comprising:

extending a displacement member movably under a number of chips in a stack of chips carried in a channel of a chip stack carrier, the displacement member movably coupled relative to a base member;

initiating a signal using a sensor when the sensor detects a presence of a selected maximum number of chips to be displaced upon movement of the displacement member relative to the base member; and selectively moving the displacement member relative to the base member in response to the signal initiated by the sensor using an energy-responsive device and displacing the number of chips in the stack of chips carried in the channel of the chip stack carrier.

8. The method of claim 7, wherein selectively moving the displacement member relative to the base member in response to the signal initiated by the sensor using the energy-responsive device comprises selectively moving the displacement member relative to the base member in response to the signal initiated by the sensor using at least one of an electric motor, an electrically operated solenoid, a pneumatically operated drive, and a hydraulically operated drive.

9. The method of claim 7, further comprising using a microprocessor device to control operation of the sensor and the energy-responsive device.

10. The method of claim 9, wherein using the microprocessor device to control operation of the sensor and the energy-responsive device comprises causing the energy-responsive device to move the displacement member relative to the base member from a non-actuated position to an actuated position in which the selected maximum number of chips are displaced by the displacement member in response to detection by the sensor of the selected maximum number of chips.

11. The method of claim 10, further comprising maintaining the displacement member in the actuated position at least until the sensor detects that the number of chips displaced by the displacement member has been removed from the channel of the chip stack carrier.

12. The method of claim 11, further comprising returning the displacement member to the non-actuated position when the sensor detects that the number of chips displaced by the displacement member has been removed from the channel of the chip stack carrier.

13. The method of claim 7, wherein selectively moving the displacement member relative to the base member in response to the signal initiated by the sensor using theenergy-responsive device comprises selectively rotating the energy-responsive device using a cam member operatively coupled to the energy-responsive device.

14. The method of claim 13, wherein selectively moving the displacement member relative to the base member in response to the signal initiated by the sensor using theenergy-responsive device comprises abutting a lever movably coupled to the base member against the displacement member and moving the displacement member by rotating the cam member.

15. The method of claim 7, further comprising biasing the displacement member to a first position relative to the base member in which the displacement member extends under a number of chips in a stack of chips carried by a chip stack carrier without displacing the number of chips relative to other chips in the stack of chips.

16. The method of claim 7, wherein selectively moving the displacement member relative to the base member comprises pivoting the displacement member relative to the base member.

17. The method of claim 7, further comprising sensing a position of at least one of the base member and the displacement member using a sensor.

18. A method for stacking and cutting chips, comprising:

receiving unstacked chips in a container;

transporting at least some of the unstacked chips from the container to at least one channel of a chip stack carrier configured to carry a stack of chips using a chip transport system;

ejecting the at least some of the unstacked chips into the at least one channel of the chip stack carrier using at least one chip ejector system, thereby forming at least one stack of chips; and cutting the at least one stack of chips using at least one chip stack cutter device, comprising:

extending an elongated displacement member under a number of chips in the at least one stack of chips carried by the chip stack carrier, the elongated displacement member movably coupled relative to a base member; and displacing the number of chips in the at least one stack of chips relative to the at least one channel responsive to movement of at least one of an actuating lever member and an energy-responsive device.

19. The method of claim 18, wherein transporting at least some of the unstacked chips from the container to at least one channel of a chip stack carrier configured to carry a stack of chips using a chip transport system comprises:

selectively rotating a disc oriented at an acute angle relative to a gravitational field;

receiving the at least some of the unstacked chips within a plurality of chip slots on or in the disc, each chip slot of the plurality of chip slots having a size and shape configured to receive a single chip therein, wherein selectively rotating the disc comprises causing each chip slot of the plurality of chip slots to pass through at least a portion of the container and toward the chip stack carrier.

20. The method of claim 18, wherein cutting the at least one stack of chips using at least one chip stack cutter device comprises cutting a plurality of stacks of chips using a plurality of chip stack cutter devices each configured to slide within a different channel of a plurality of channels of the chip stack carrier.

* * * * *